United States Patent [19]

Hunter

[11] Patent Number: 4,718,605

[45] Date of Patent: Jan. 12, 1988

[54] REVERSIBLE GEAR OSCILLATING SPRINKLER

[76] Inventor: Edwin J. Hunter, 5551 Codorniz Rd., Rancho Santa Fe, Calif. 92067

[21] Appl. No.: 909,487

[22] Filed: Sep. 19, 1986

[51] Int. Cl.[4] ..... B05B 3/16

[52] U.S. Cl. ..... 239/242; 74/97

[58] Field of Search ..... 239/240, 242; 74/97, 74/100 R

[56] References Cited

U.S. PATENT DOCUMENTS

| | | | |
|---|---|---|---|
| 1,492,878 | 5/1924 | Eklundh | 74/97 |
| 2,895,681 | 7/1959 | Kachergis | 74/97 |
| 2,902,888 | 9/1959 | Powischill et al. | 74/97 |
| 3,107,056 | 10/1963 | Hunter | 239/240 |
| 4,568,024 | 2/1986 | Hunter | 239/242 |

*Primary Examiner*—Andres Kashnikow
*Assistant Examiner*—Michael J. Forman
*Attorney, Agent, or Firm*—Baker, Maxham & Jester

[57] ABSTRACT

A gear driven oscillating sprinkler head includes a reversible gear train for transmitting drive from a drive motor to the oscillating sprinkler head with a shifting mechanism, including a shiftable carrier on which a pair of driving pinions are mounted for shifting alternately into driving engagement with an internal ring gear, with a lost motion connection between a shifting arm and the carrier with separate over-center spring units for separately biasing the carrier and shifting arm to the alternate driving engagement positions.

12 Claims, 4 Drawing Figures

REVERSIBLE GEAR OSCILLATING SPRINKLER

BACKGROUND OF THE INVENTION

The present invention relates to sprinkler units and pertains particularly to a special reversible drive gear system for oscillating sprinklers.

In my prior U.S. Pat. No. 3,107,056, issued October 15, 1963, entitled "Sprinkler", I disclose a gear driven oscillating pop-up type sprinkler. In that patent, the drive train includes a shifting mechanism that alternately shifts a pair of terminal gears carried on a shifting plate into and out of engagement with an internal gear at the ends of the oscillating stroke. In adapting that drive system to more compact higher pop-up stroke higher volume sprinklers, certain problems with the shifting mechanism were encountered.

The chief difficulty encountered was the different engaging and shifting forces present in the shifting mechanism. The shifting mechanism has a very strong self-engaging force when turning in the same direction as the input drive. A great deal of force is required to disengage the drive and shift to the opposite direction. This problem was solved in my U.S. Pat. No. 4,568,024, issued Feb. 4, 1986, entitled "Oscillating sprinkler".

However, a new problem has been discovered, namely when the sprinkler unit stops while in the process of shifting from one direction to the opposite direction, the terminal gear becomes disengaged from the ring gear. When the water is again turned on, the drive remains disengaged and will not function. The sprinkler unit is then considered defective and is typically discarded or returned to the vendor for replacement.

It has been discovered that the lost motion connection between the shifting arm and the carrier allows the shifting arm to be biased to a position short of the over center position, such that the carrier allows the terminal gear to become disengaged. This condition can occur when the sprinkler head is turned manually to check or adjust the coverage.

It is, therefore, desirable that an improved gear drive be available for sprinkler units that overcomes this problem.

SUMMARY AND OBJECTS OF THE INVENTION

It is, therefore, the primary object of the present invention to provide an improved reversible driver for an oscillating sprinkler unit.

In accordance with the primary aspect of the present invention, an oscillating gear drive train for an oscillating sprinkler head includes a first pinion shiftable into engagement with an internal gear for driving in one direction, and a second pinion shiftable into engagement with the gear for driving in the opposite direction, with first and second pinions mounted on a shiftable carrier and having over-center means acting directly on the shiftable carrier for maintaining the first and second pinions in positive drive engagement.

BRIEF DESCRIPTION OF THE DRAWING

The above and other objects and advantages of the present invention will become apparent from the following description when read in conjunction with the drawings wherein.

DETAILED DESCRIPTION OF A PREFERRED EMBODIMENT

Figure 1:
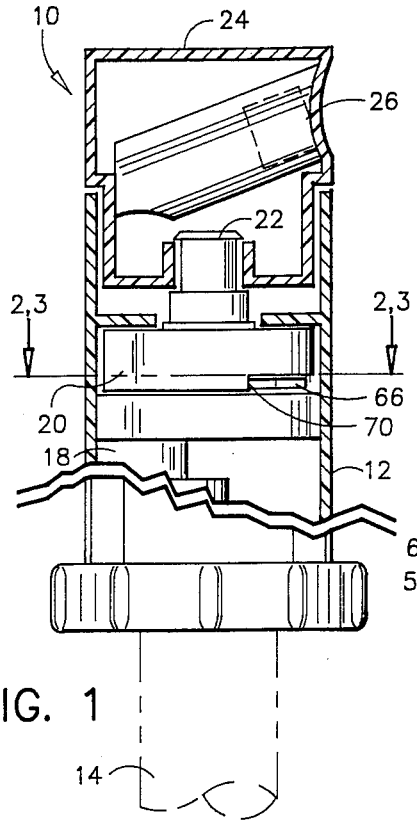
FIG. 1 is a side elevation view partially cut away of a typical sprinkler unit incorporating the gear drive assemblies.

Turning to FIG. 1 of the drawing, a sprinkler unit, designated generally by the numeral 10, includes a generally cylindrical housing 12 having an inlet opening at the bottom, not shown, which is connectable to a source of water such as a fixed water line or the like 14. The sprinkler unit includes a typical drive motor 16, such as a water turbine or the like, which is drivingly coupled through a gear train 18, the details of which are not shown, for driving a reversible drive gear train, as will be subsequently disclosed and discussed, which is contained within an oscillating drive unit 20. The oscillating drive unit 20 is in the form of a generally cylindrical housing mounted in the upper end of the cylindrical housing 12 and is coupled through a hollow or tubular drive shaft 22 to a sprinkler head or nozzle unit 24. The nozzle unit 24 is mounted for rotation with the shaft 22 for rotating about the axis thereof. The shaft 22 is also tubular and serves as a water flow conduit for conveying water to the nozzle unit 24 from the lower portion of the housing.

The basic drive arrangement is substantially like that disclosed in my prior U.S. Pat. Nos. 3,107,056, issued Oct. 15, 1963, entitled "sprinkler", and 4,568,024, issued Feb. 4, 1986, entitled "Oscillating sprinkler". The contents of these patents are incorporated herein by reference as though fully set forth.

Figure 2:
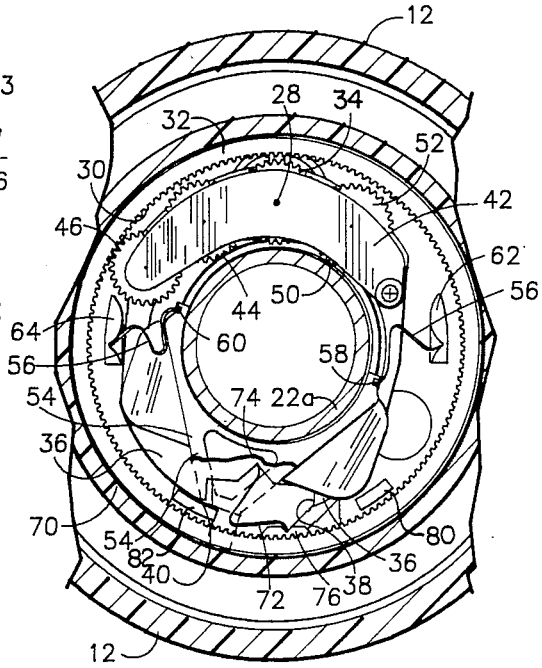
FIG. 2 is an enlarged sectional view taken on line 2—2 of FIG. 1.
Figure 3:
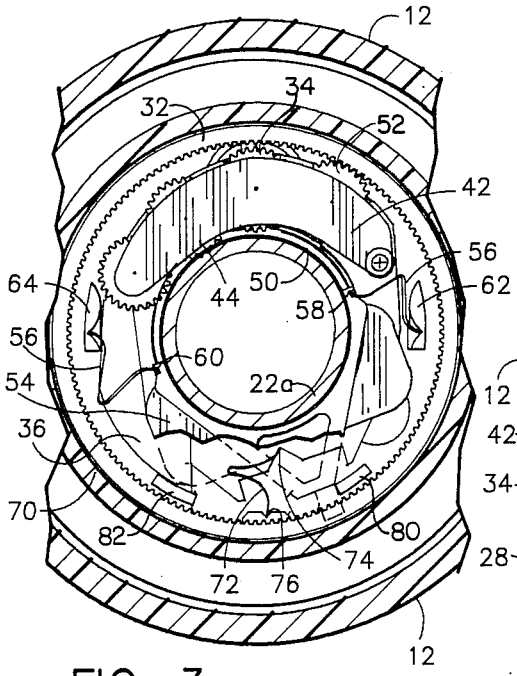
FIG. 3 is a similar sectional view with a drive direction reversed.
Figure 4:
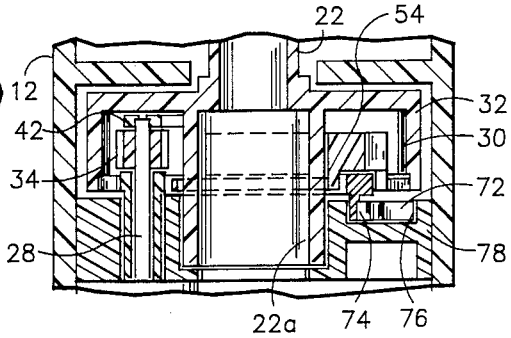
FIG. 4 is a sectional view taken on line 4—4 of FIG. 3.

The oscillating head 24 is driven in alternate directions by a reversible drive assembly, which is best illustrated in FIGS. 2–4. The drive assembly comprises a reversible gear train and includes an input shaft 28, which is driven by a suitable motor or turbine 16 powered by the water flowing through the unit. The shaft 28 is mounted for rotation about an axis positioned paralle and to one side of the central axis of the rotatable member 22. The input shaft 28 carries an input pinion gear 34 positioned between the central axis, and an internal gear 30 formed on the downwardly turned skirt portion 32 of the output drive unit 20. The input pinion gear 34 is mounted on the shaft 28 for rotating therewith and for driving a pair of shiftable gear trains that alternately shift into driving engagement with the internal gear 30, as will be described.

The shifting gear trains comprise a pivoting yoke or carrier, including a lower annular plate 36, which surrounds the central drive shaft 22 and is pivotally mounted on the shaft 28 for pivotal movement about the axis thereof. The shiftable yoke plate 36 includes a pair of oppositely driven terminal gears 46 and 52, which are driven by the input pinion 34 by way of one or more idler gears as needed. The yoke assembly includes an upper plate 42, between which is mounted a first gear train, comprising an idler gear 44 driven by the input gear 34 and an outer or terminal pinion gear 46 for drivingly engaging the internal gear 30 for driving it in a counterclockwise direction. A second gear train includes the input gear 34, drivingly engaging terminal gear 52, which in turn drivingly engages the internal ring gear 30 for driving the ring gear in the clockwise direction, as seen in FIG. 2. The yoke assembly, including the plate 36, pivots about the axis of shaft 28 for pivoting to alternate positions, as shown respectively in FIGS. 2 and 3, for alternately shifting the terminal gears of the drive trains selectively into driving engagement with the internal ring gear 30 for driving the ring gear and the sprinkler head in alternate directions.

As shown in FIG. 2, the first gear train, including idler gear 44 and terminal drive gear 46, are in driving engagement with the internal ring gear 30 such that the ring gear is driven by the gear 46 in a counterclockwise direction.

Referring to FIG. 3, the shifting yoke 36 has been tilted in the opposite direction, such that the terminal drive gear 52 is in driving engagement with the internal ring gear 30 for driving the ring gear in the clockwise direction, with the input gear 34 driven in the counterclockwise direction, as shown in FIG. 2.

The shifting yoke 36 is pivoted about the axis of shaft 28 by means of a shifting level 54, which is rotatably mounted on the lower tubular extension 22*a* of the shaft 22. The shifting lever 54 is connected to the yoke by a lost-motion connection comprising a downward extension portion thereof to finger or arm 66 which alternately engages shoulders 38 and 40 of the yoke. The shifting lever 54 is biased to its alternate positions by a pair of identical over-center springs 56 engaging notches 58 and 60 on opposite sides of the lever 54 and engaging notches 62 and 64 on extensions of the housing 12.

The lever 54 is shifted by the ring gear 30 by the engagement of the outer tip 66 of the level 54 by opposing shoulders 80 and 82 for shifting it about its axis. This shifts it against the over-center springs 56, which forces the lever 54 to engage shoulders 38 and 40 of the yoke forcing yoke 36 to pivot about its axis 28. This shifts alternate ones of the gears 46 and 52 into driving engagement with the internal ring gear 30.

An over-center spring 72 is mounted between a notch 74 on yoke 36 and notch 76 on a stationary housing portion 70, for providing a positive biasing of the yoke 36 to its extreme positions independently of the biasing of the shifting lever 54. This maintains the terminal gears positively biased to the engaging position independently of the shifting lever 54. Thus, if the water should be cut off as the ring gear 30 is moving the shifting lever 54 to the over-center position, the terminal gear 46 or 52 will remain engaged under the positive bias of over-center spring 72. Thus, when the water is turned on, the drive will be engaged and continue to drive internal gear 30 which will continue to shift lever 54. This eliminates the problem of the unit stalling in an intermediate position between alternate drive positions.

At the position, as shown in FIG. 2, the lever 54 has just been forced over-center in a clockwise direction under engagement by shoulder 80 of the ring gear, thereby engaging shoulder 40 and shifting the yoke 36 to shift gear 46 into driving engagement with the ring gear 30. The ring gear 30 now begins to turn in the counterclockwise direction until shoulder 82 thereof engages the lever tip 66 of lever 54, shifting it back in the counterclockwise direction, as shown in FIG. 3. This shifts the gear 46 out of engagement with the ring gear, and the gear 52 back into driving engagement. Continued rotation of the input gear 34 then immediately reverses direction of the ring gear 30, forcing it to begin rotating in the clockwise direction.

The stroke of the drive and the angle of coverage of the resulting output will be determined by the angle or the length of the slot between actuating shoulders 80 and 82 on the ring gear.

Thus, while I have illustrated and described my invention by means of specific embodiments, it is to be understood that numerous changes and modifications may be made therein without departing from the spirit and scope of the invention as defined in the appended claims.

I claim:

1. An oscillating sprinkler unit, comprising:

a sprinkler head mounted for rotation about a first axis;

a drive motor;

a reversible gear train for drivingly connecting said drive motor for driving said sprinkler head in alternate directions, comprising final drive gear means connected to said sprinkler head, shiftable drive means comprising alternately operable terminal gear means and carrier means for carrying said terminal gear means and shiftable to alternately engageable positions with said final drive gear means for driving said sprinkler head in alternate directions;

shifting arm means pivotally mounted adjacent said carrier means and movable between alternate shifting positions by engagement with shoulder means carried by said final drive gear means, and lost motion means for connecting said shifting arm means with said carrier means for shifting said carrier means between said alternately engageable positions upon movement of said shifting arm means between said alternate shifting positions;

first over-center biasing means for maintaining said carrier means in a selected one of said alternately engageable positions until positively shifted therefrom by said shifting arm means; and second over-center biasing means for maintaining said shifting arm means in a selected one of alternate shifting positions by said shoulder means.

2. The sprinkler of claim 1 wherein:

said shiftable drive means comprises a drive gear driven by said drive motor and mounted for rotation about a second axis spaced from said first axis;

said carrier means is mounted for pivotal movement about said second axis; and said shifting arm means is mounted for pivotal movement about said first axis.

3. The sprinkler unit of claim 2 wherein:

said carrier means comprises a yoke surrounding said first axis and said lost motion means comprises shoulder means on the opposite side of said first axis from said second axis for alternate engagement with said shifting arm means.

4. The sprinkler unit of claim 3 wherein:

said first over-center means comprises a spring engaging said yoke between said shoulder means.

5. The sprinkler of claim 4 wherein:

said spring comprises a generally U-shaped leaf spring.

6. The sprinkler system of claim 4 wherein:

said first over-center means maintains said terminal gear means in engagement until said said yoke is biased by said second over-center means through said shifting arm means.

7. An oscillating sprinkler unit, comprising:

a sprinkler head mounted for rotation about a first axis;

a drive motor;

a reversible gear train for drivingly connecting said drive motor for driving said sprinkler head in alternate directions, comprising a final drive gear connected to said sprinkler head, shiftable drive means comprising alternately operable terminal gear means and carrier means for carrying said terminal gear means and shiftable to alternately engageable positions with said final drive gear for driving said sprinkler head in alternate directions;

shifting arm means pivotally mounted adjacent said carrier means and movable between alternate shifting positions by engagement with shoulder means carried by said final drive gear means, and lost motion means for providing engagement with said carrier means for shifting said carrier means between said alternately engageable positions upon movement of said shifting arm means between said alternate shifting positions;

first over-center biasing means for maintaining said carrier means in a selected one of said alternately engageable positions until positively shifted therefrom by said shifting arms means; and second over-center biasing means for maintaining said shifting arm means in a selected one of alternate shifting positions by said shoulder means.

8. The sprinkler of claim 7 wherein:

said shiftable drive means includes a drive gear driven by said drive motor and mounted for rotation about a second axis spaced from said first axis;

said carrier means mounted for pivotal movement about said second axis; and said shifting arm means mounted for pivotal movement about said first axis.

9. The sprinkler unit of claim 8 wherein:

said carrier means comprises a yoke surrounding said first axis and said lost motion means comprises shoulder means on the opposite side of said first axis from said second axis;

said over-center means comprises spring means engaging said yoke between said shoulder means; and said spring means comprises a generally U-shaped leaf spring.

10. The sprinkler system of claim 9 wherein:

said first over-center means maintains said terminal gear means in engagement until said yoke is biased by said second over-center means through said shifting arm means.

11. An oscillating sprinkler unit, comprising:

a housing having a generally cylindrical configuration with a central axis, an inlet at a lower end for attachment to a source of water and an outlet at an upper end;

a sprinkler head mounted at said upper end for rotation about said central axis;

a drive motor mounted in said housing for driving said sprinkler head;

a shiftable gear train comprising terminal drive gear means, including a pair of terminal gears, and an internal gear connected to said sprinkler head, shiftable means for alternatively shifting said terminal gears alternatively into engagement with said internal gear for driving said sprinkler head in alternate directions;

said shiftable gear train comprising a drive shaft driven by said drive motor and a drive gear mounted for rotation about a second axis offset from said first axis;

a pivoting yoke including a carrier mounted for pivotal movement about said second axis;

one of said terminal gears mounted on said carrier on one side of said second axis, and the other of said terminal gears mounted on said carrier on the other side of said second axis;

a shifting arm means mounted adjacent said yoke for pivotal movement about said first axis to alternate shifting positions by engagement with shoulder means carried by said internal gear;

lost motion means disposed between said shifting arm and said yoke for connecting said shifting arm means to said yoke for shifting said terminal gears to alternately engageable positions;

first over-center biasing means for maintaining said carrier in a selected one of said alternately engageable positions until positively shifted therefrom by said shifting arm means; and second over-center biasing means for maintaining said shifting arm means in a selected one of said alternate shifting positions until engagement by said shoulder means.

12. A sprinkler unit according to claim 11 wherein:

said first over-center biasing means comprises a generally U-shaped spring disposed between said carrier and fixed means on said housing for biasing said carrier to said one of said alternately engageable positions.

* * * * *

Notice of Adverse Decision in Interference

In Interference No. 101,982, involving Patent No. 4,718,605, E. J. Hunter, REVERSIBLE GEAR OSCILLATING SPRINKLER, final judgement adverse to the patentee was rendered Sept. 5, 1990, as to claims 1-12.

(*Official Gazette March 5, 1991*)